US011136989B2

(12) United States Patent
Sakanassi García et al.

(10) Patent No.: US 11,136,989 B2
(45) Date of Patent: Oct. 5, 2021

(54) IMPELLER FOR CENTRIFUGAL RADIAL PUMP

(71) Applicant: RUHRPUMPEN SA de CV, Nuevo León (MX)

(72) Inventors: Yubal Sakanassi García, Nuevo Leon (MX); Victor de Jesús Melendez-Leal, Nuevo Leon (MX); Ovidio Montalvo Fernández, Nuevo Leon (MX); Tine Gantar, Ljubljana (SI)

(73) Assignee: RUHRPUMPEN SA DE CV

( * ) Notice: Subject to any disclaimer, the term of this patent is extended or adjusted under 35 U.S.C. 154(b) by 100 days.

(21) Appl. No.: 16/550,749

(22) Filed: Aug. 26, 2019

(65) Prior Publication Data

US 2021/0062819 A1 Mar. 4, 2021

(51) Int. Cl.
*F04D 29/24* (2006.01)
*F04D 17/08* (2006.01)

(52) U.S. Cl.
CPC ..... *F04D 29/242* (2013.01); *F04D 17/08* (2013.01)

(58) Field of Classification Search
CPC . F04D 17/08; F04D 1/00; F04D 29/22; F04D 29/2205; F04D 29/2211; F04D 29/2216; F04D 29/2238; F04D 29/2261; F04D 29/285; F04D 29/242; F04D 29/24; F04D 29/245; F04D 29/2266; F04D 29/2255; F04D 29/30
USPC ..... 416/182, 185
See application file for complete search history.

(56) References Cited

U.S. PATENT DOCUMENTS 776,835 A * 12/1904 Goth ..... F04D 29/2266 415/106
1,867,290 A * 7/1932 Vitu ..... F04D 29/2266 415/106
8,444,370 B2 * 5/2013 Gulich ..... F04D 29/2266 415/1
2018/0112673 A1 * 4/2018 Manninen ..... F04D 29/22

OTHER PUBLICATIONS

Dr. Tine Gantar, Envita, Short Status Report, Apr. 13, 2017, pp. 1-21, Slovenia.

* cited by examiner

*Primary Examiner* — Bryan M Lettman
(74) *Attorney, Agent, or Firm* — McAfee & Taft

(57) ABSTRACT

An impeller designed for use in radial pumps. The impeller compensates for axial forces during pumping operations. The impeller utilizes vanes having 3D geometry which extend from the impeller intermediate plate eye to the external diameter of the intermediate plate. On the backside of the intermediate plate, the vanes define a plurality of hydraulic passages. The hub plate also includes a series of balancing holes.

23 Claims, 16 Drawing Sheets

IMPELLER FOR CENTRIFUGAL RADIAL PUMP

BACKGROUND

Impellers commonly used in centrifugal radial pumps experience stresses induced during pump operation. One common stress that leads to failure is the axial thrust experienced by the impeller. Axial thrust places stress on the shaft bearing supporting the impeller and on the impeller itself as the impeller flexes in response to the axial forces. Such failures occur most frequently in centrifugal pumps with small specific rotational speeds ($n_q$), e.g. as low as 10 $min^{-1}$ or even less, using open type impellers are the open-typed, i.e. impellers with vanes that are not covered with plates. Impellers that generate high values of head at very little flow rates generally operate at a very low specific speed. Impellers as described in accordance to this disclosure reaches Head values from 50 to 520 m while operating under low flows of 1.1 $m^3/h$ to 76.7 $m^3/h$.

SUMMARY

Disclosed is an impeller for a centrifugal pump. The impeller comprises an intermediate plate which defines a suction side and a backside, a hub plate having an axle hole passing therethrough with the center of the axle hole defining the center line of the impeller. The impeller also includes an impeller intermediate plate eye on the suction side of the intermediate plate. The impeller intermediate plate eye aligns concentrically with the axle hole. The impeller includes a plurality of vanes bisected by the intermediate plate. Each vane has a first vane section located on the suction side of the intermediate plate and a second vane section located on the back side of the intermediate plate. At least a portion of the second vane sections join the hub plate to the intermediate plate and define fluid passageways between the intermediate plate and the hub plate. Each of the vanes has a first end proximate to the impeller intermediate plate eye and a second end located at the outer edge of the intermediate plate. The impeller also has a plurality of balance holes passing through the hub plate. The balance holes are positioned concentrically about the axle hub and at least one balance hole is positioned between adjacent second vane sections. The impeller has 3D geometry. Each vane first end defines an angle of about 15° to about 25° relative to the center line of the impeller and each vane second end defines an angle of about 90° relative to the center line of the impeller. Additionally, the 3D geometry provides that each vane first end has an angle of inclination relative to the hub plate that is greater than the angle of inclination at the vane second end.

BRIEF DESCRIPTION OF THE DRAWINGS

FIG. 6 is a cross-sectional view depicting the vanes bisected by the intermediate plate and the hub plate.

FIG. 9 is a computational stress analysis of the impeller depicted in FIG. 3 depicting the distribution loads applied to the impeller.

FIG. 13A depicts an assembled centrifugal pump and FIG. 13B depicts an exploded view of a centrifugal pump of the type incorporating the improved impeller.

DETAILED DESCRIPTION

Figure 1:
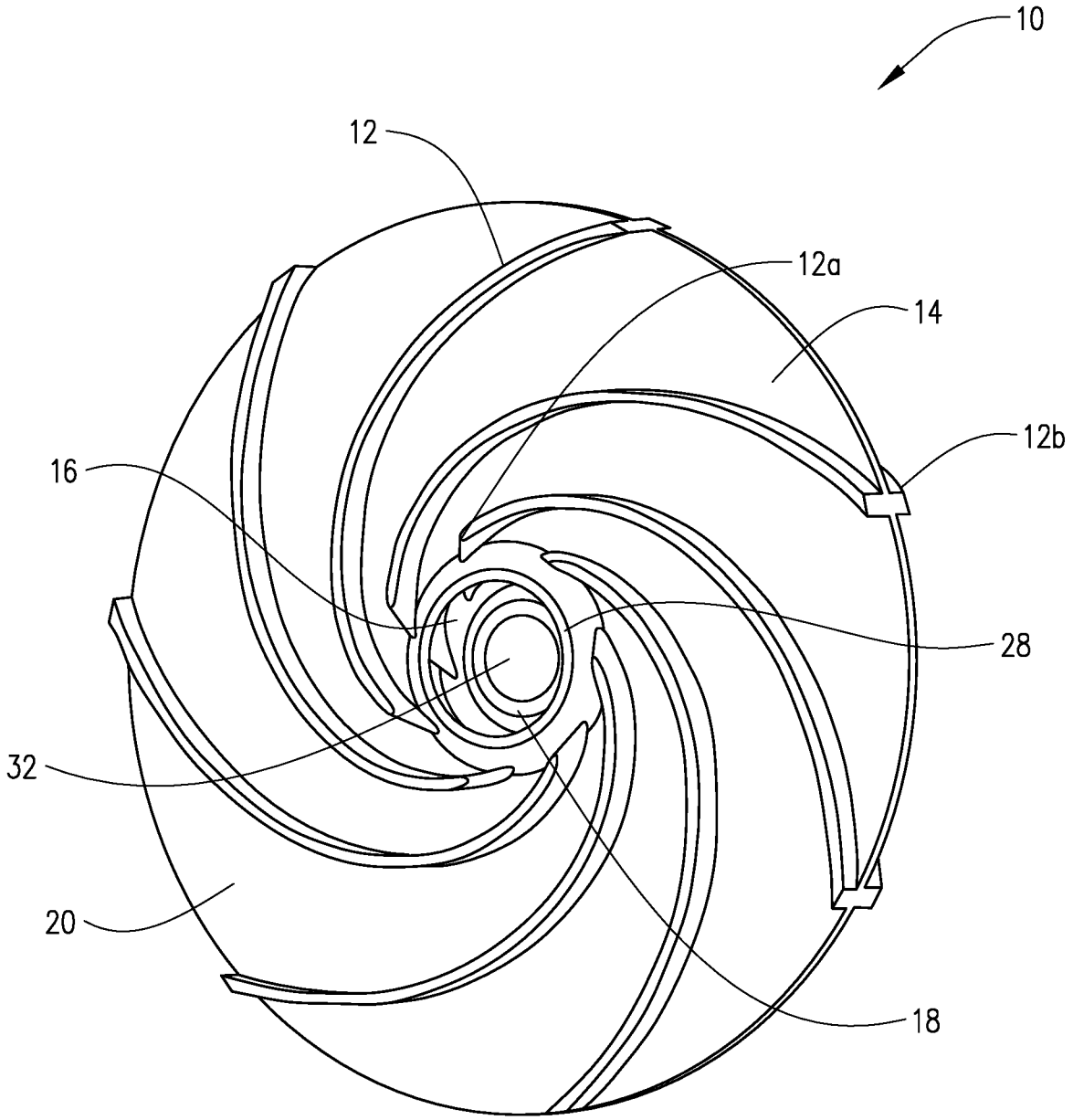
FIG. 1 is a perspective view of one embodiment of the improved impeller.
Figure 2A:
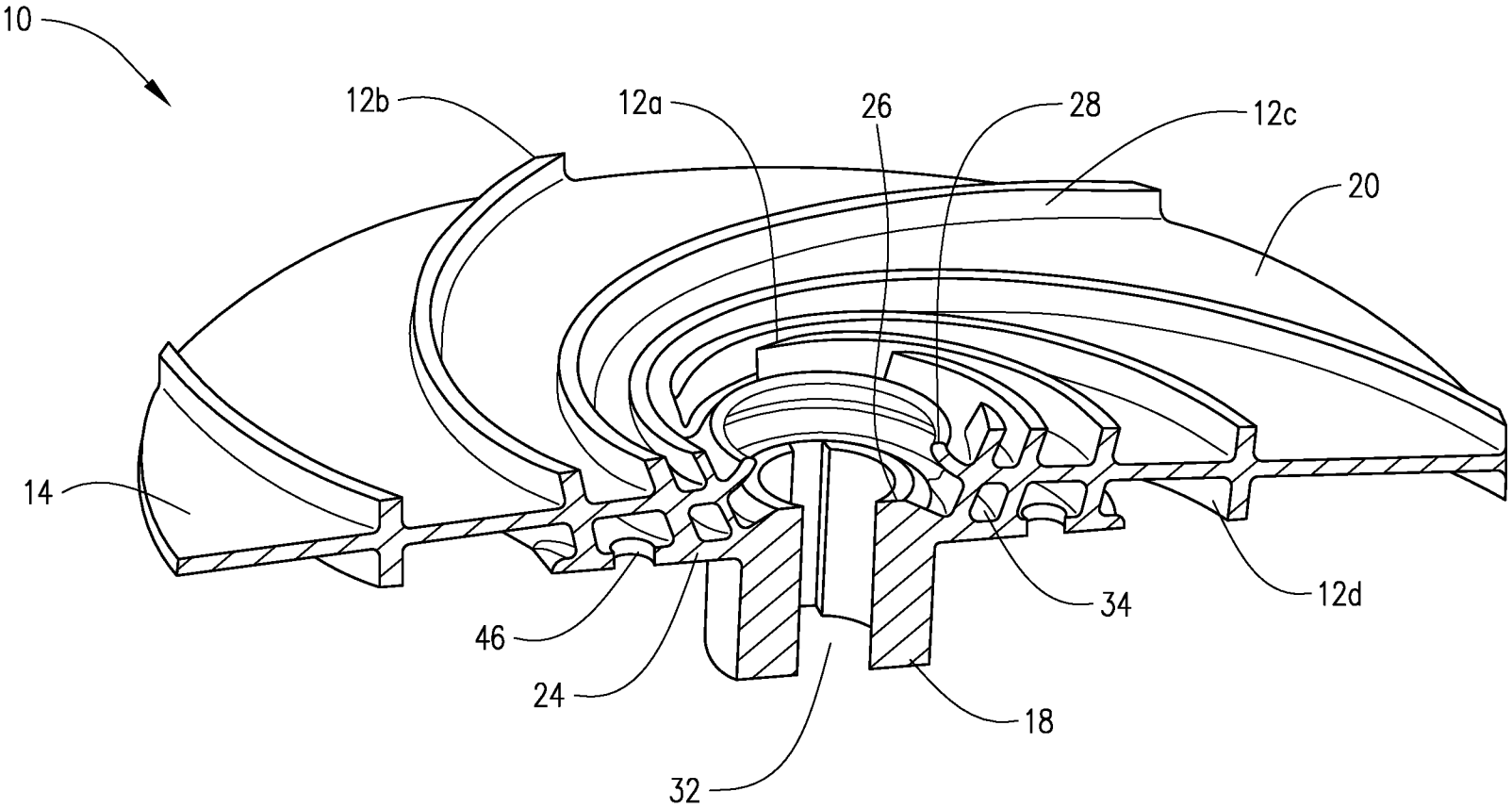
FIGS. 2A and 2B are perspective cross-sectional views of the suction side and backside, respectively, of the improved impeller of FIG. 1.
Figure 2E:
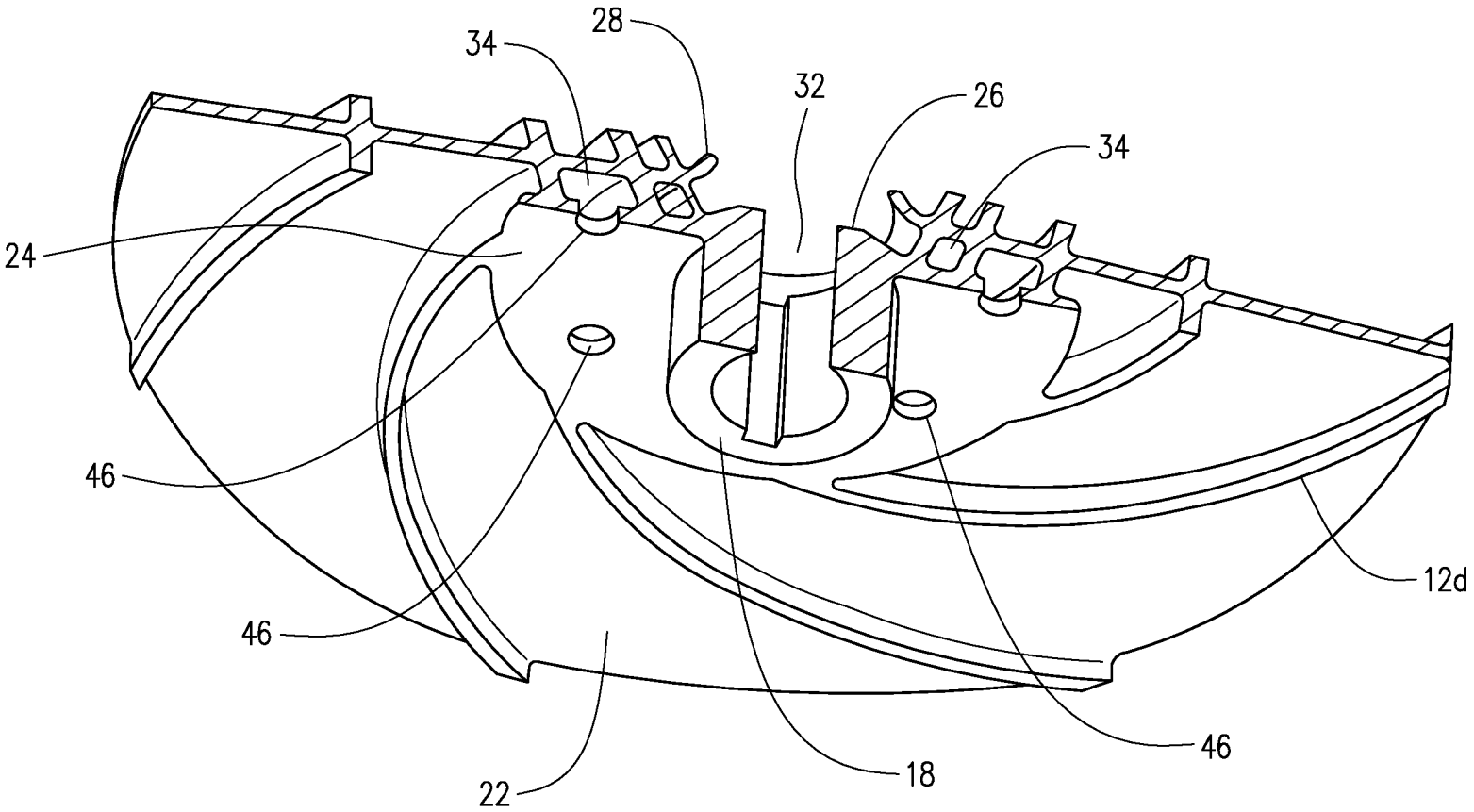
Figure 3:
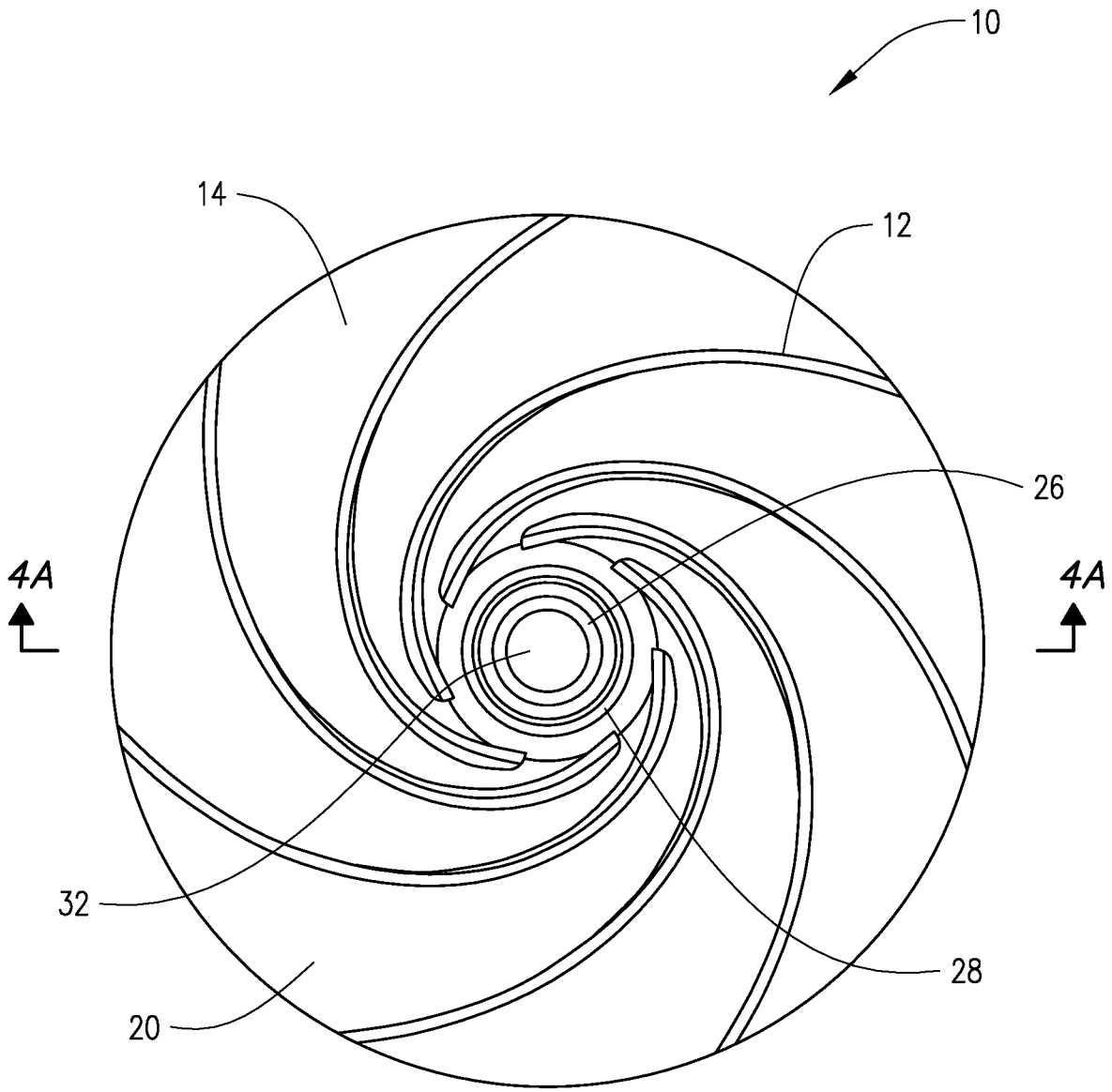
FIG. 3 is a top view of the impeller of FIG. 1.

Throughout this disclosure, the terms "about", "approximate", and variations thereof, are used to indicate that a value includes the inherent variation or error for the device, system, the method being employed to determine the value, or the variation that exists among the study subjects.

This disclosure relates to an improved impeller suitable for use in single stage pumps. The improved impeller reduces axial thrust thereby extending the life of the impeller and the pump. The FIGS. depict the various embodiments of the improved impeller 10. One particular improvement in the improved impeller apparent from the FIGS. is the lack of splitter vanes in each of the embodiments. Additionally, improved impeller 10 is configured to ensure that the volume of fluid moved by both sides of impeller 10 is substantially equal. Thus, improved impeller 10 reduces cavitation, axial flexing and stress on the impeller.

With reference to FIGS. 1-8, depicted is impeller 10. Impeller 10 has a plurality of vanes 12 bisected by intermediate plate 14. The number of vanes 12 carried by impeller 10 may range from 5 to 11 depending on the size of the pump 50. In most cases impeller 10 will have seven vanes 12. First vane sections 12*c* are found on the suction side 20 of intermediate plate 14 and second vane sections 12*d* are found on the backside of 22 of intermediate plate 14. Intermediate plate 14 has a centrally located axle hub 18. Axle hub 18 has an axle hole 32 extending from suction side 20 to backside 22. The center axis of axle hole 32 defines the center line 36 of impeller 10. Axle hub 18 also includes an axle hub plate 24 located on the backside 22 of intermediate plate 14 and a hub nose 26 located on the suction side of intermediate plate 14. In the area covered by axle hub plate 24, second vane sections 12*d* join axle hub plate 24 to intermediate plate 14. The backside of axle hub plate 24 defines a plane which is perpendicular to impeller center line 36.

Located concentrically about axle hole 32 is a low pressure region which forms during operation of the pump. The low pressure region is known as the impeller suction eye 16. Impeller suction eye 16 corresponds generally to the physical areas defined by an upwardly extending portion 28 of intermediate plate 14. This upwardly extending portion is referred to herein as impeller intermediate plate eye 28. The diameter of suction eye 16 will determine the size of the suction connection and also the pump's capacity to pump fluid. In most embodiments, impeller intermediate plate eye 28 has a height which is less than the height of vanes 12. Typically, impeller intermediate plate eye 28 will define a diameter of about 37 mm to about 79 mm and will have a height of about 17.5 mm to about 37.6 mm (height measured from the plane defined by the backside of the axle hub plate 24).

Figure 4A:
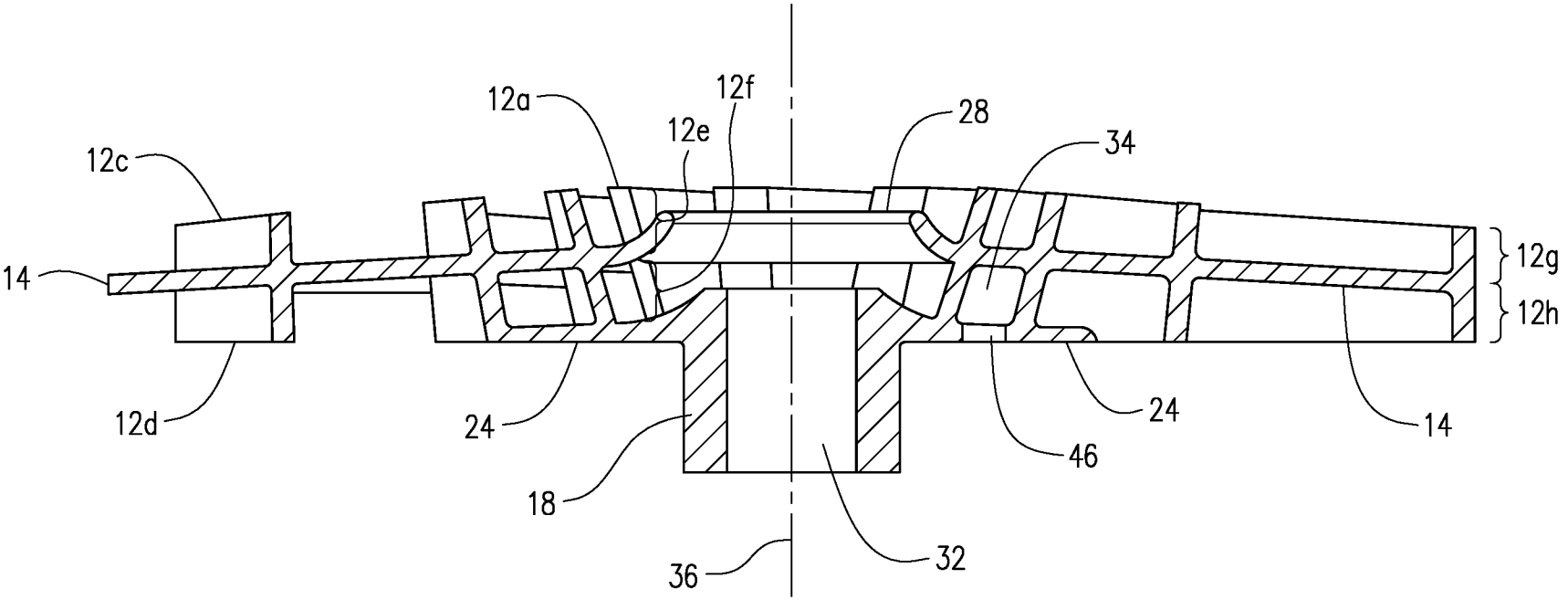
FIG. 4A is a cross-sectional view of the impeller of FIG. 3 taken along line A-A.
Figure 4E:
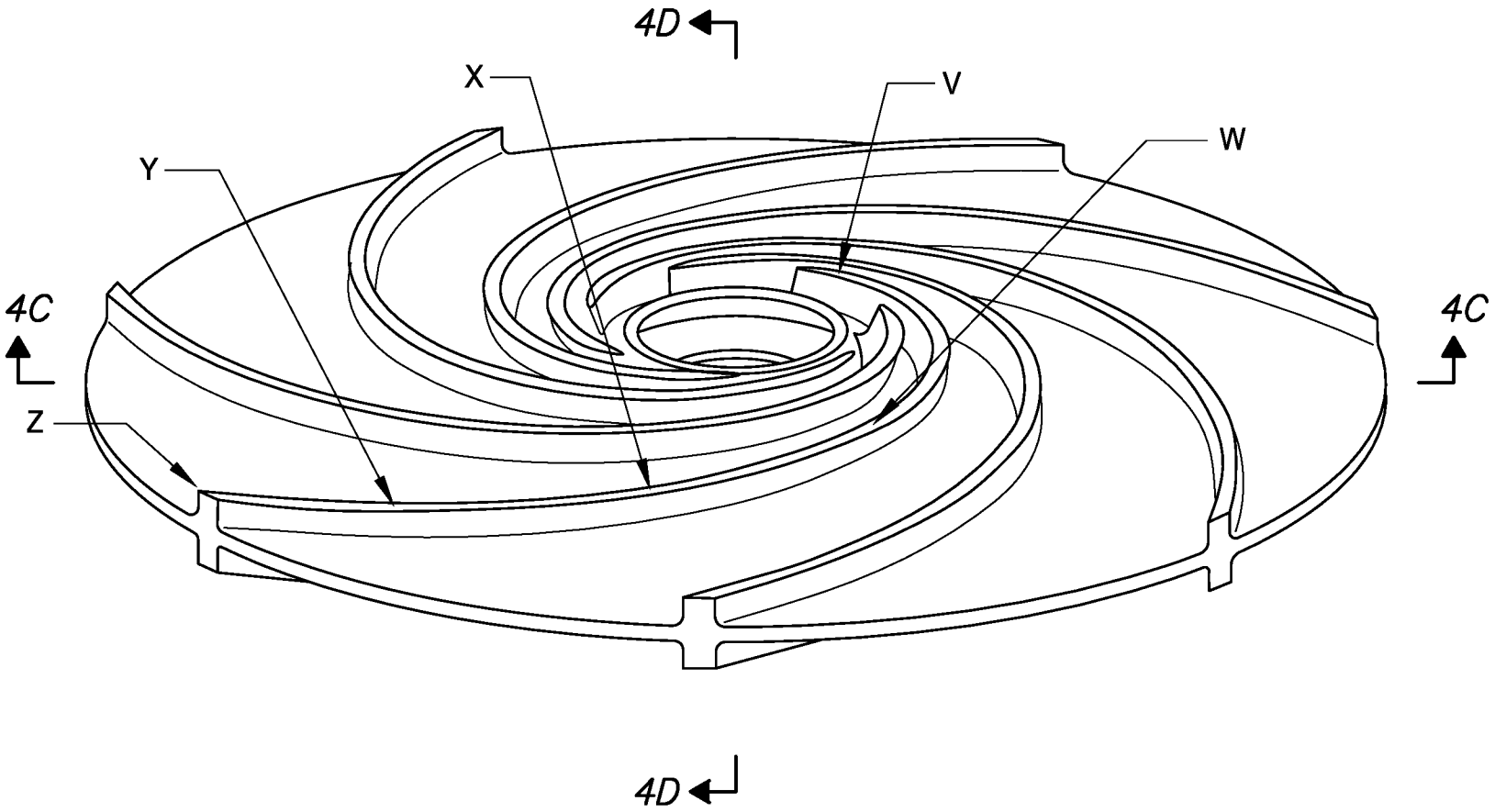
FIG. 4B is a perspective view of the impeller with identified points along a vane.
FIG. 4C is a perspective cross-sectional view taken along line A-A of FIG. 4A.
FIG. 4D is an enlarged cross-sectional view taken along line B-B of FIG. 4A.
Figure 4E:
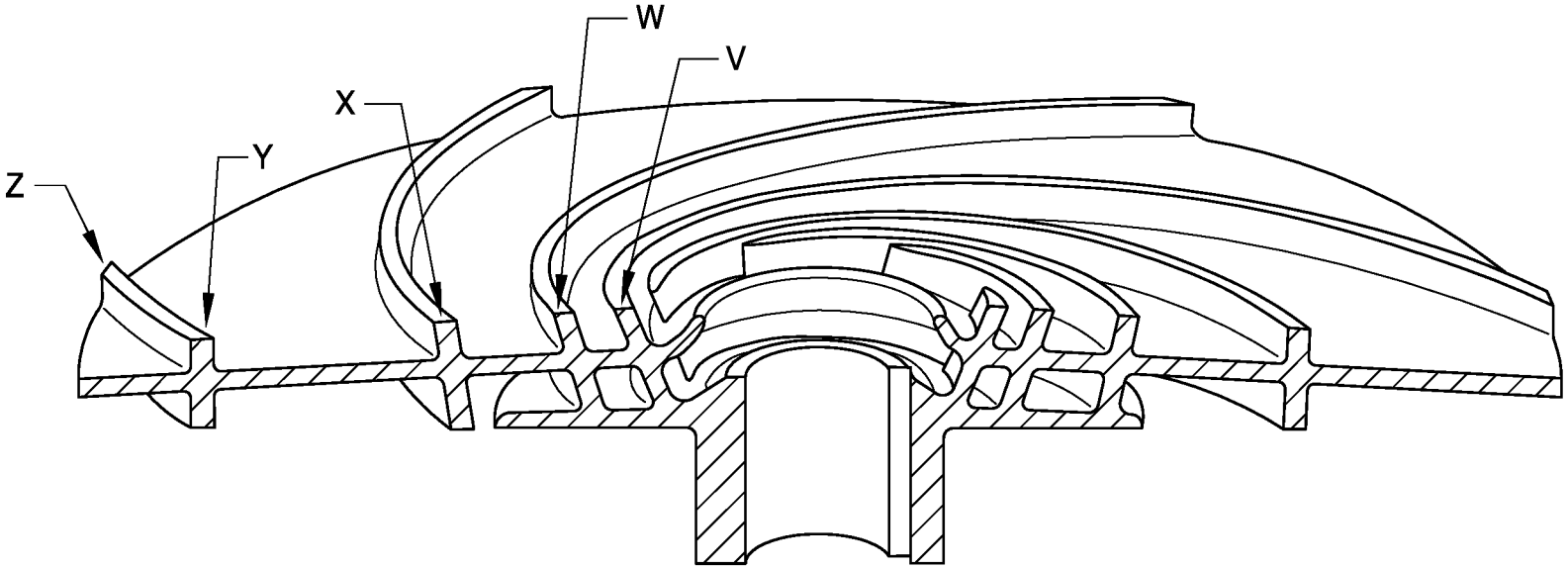

As best seen in FIGS. 4A and 6, intermediate plate 14 is a substantially flat surface which turns upward at its inner diameter to define impeller intermediate plate eye 28. With reference to the plane defined by the backside of axle hub plate 24, intermediate plate 14 defines an angle of about 3° to about 5°. See for example FIGS. 4A, 4D and 6. In the embodiment of FIGS. 4A and 6, the transition from intermediate plate 14 to impeller intermediate plate eye 28 has a radius of curvature of about 10 mm to about 45 mm.

With reference to FIGS. 2A, 2B, 4A, 5, 6 and 8 a series of balancing holes 46 located in axle hub plate 24 in cooperation with provided fluid passage 34 and impeller intermediate plate eye 28 provide fluid communication from the suction side of intermediate plate 14 to the backside 22 of intermediate plate 14. Balancing holes 46 reduce the pressure differential on impeller 10 that develops during operations by allowing fluid communication between suction side 20 and backside 22 of intermediate plate 14. As such balancing holes 46 reduce the axial stress experienced by impeller 10. In an alternative embodiment, balancing holes 46 may pass through axle hub plate 24 without affecting structure of intermediate plate 14. Balancing holes 46 typically have a diameter of about 5 mm to about 15 mm. More preferably, balancing holes 46 will have diameters between about 10 mm to about 15 mm.

Fluid passages 34 are defined by second vane section 12*d* and axle hub plate 24. Fluid passages 34 distribute the fluid from suction side 20 to backside 22 of intermediate plate 14. As depicted in FIGS. 2B and 4, fluid passages 34 pass from impeller intermediate plate eye 28 between intermediate plate 14 and axle hub plate 24 and exits at backside 22. The increased fluid communication between suction side 20 and backside 22 provided by fluid passages 34 contributes to the reduction in stress and flexing, i.e. axial thrust, experienced by impeller 10.

As depicted in the FIGS., impeller vanes 12 extend radially outward in a spiral configuration from a location adjacent to impeller intermediate plate eye 28. Each vane 12 has a first end 12*a* adjacent to or at impeller intermediate plate eye 28 and a second end 12*b* at the outer edge of intermediate plate 14. In a preferred embodiment, each first end 12*a* is located between adjacent balancing holes 46. Thus, each second vane section 12*d* separates adjacent balancing holes 46 and each second vane section 12*d* in cooperation with axle hub plate 24 defines fluid passages 34.

The configuration of each vane section 12*c* and 12*d* contributes to the reduction in stress and flexing experienced by impeller 10. In contrast to a conventional 2D vane geometry which has an angle of approximately 90° relative to the axle hub plate the entire length of the vane from location 12*a* to 12*b*, improved impeller 10 utilizes vanes having a unique geometry referred to herein as 3D geometry.

Figure 4D:
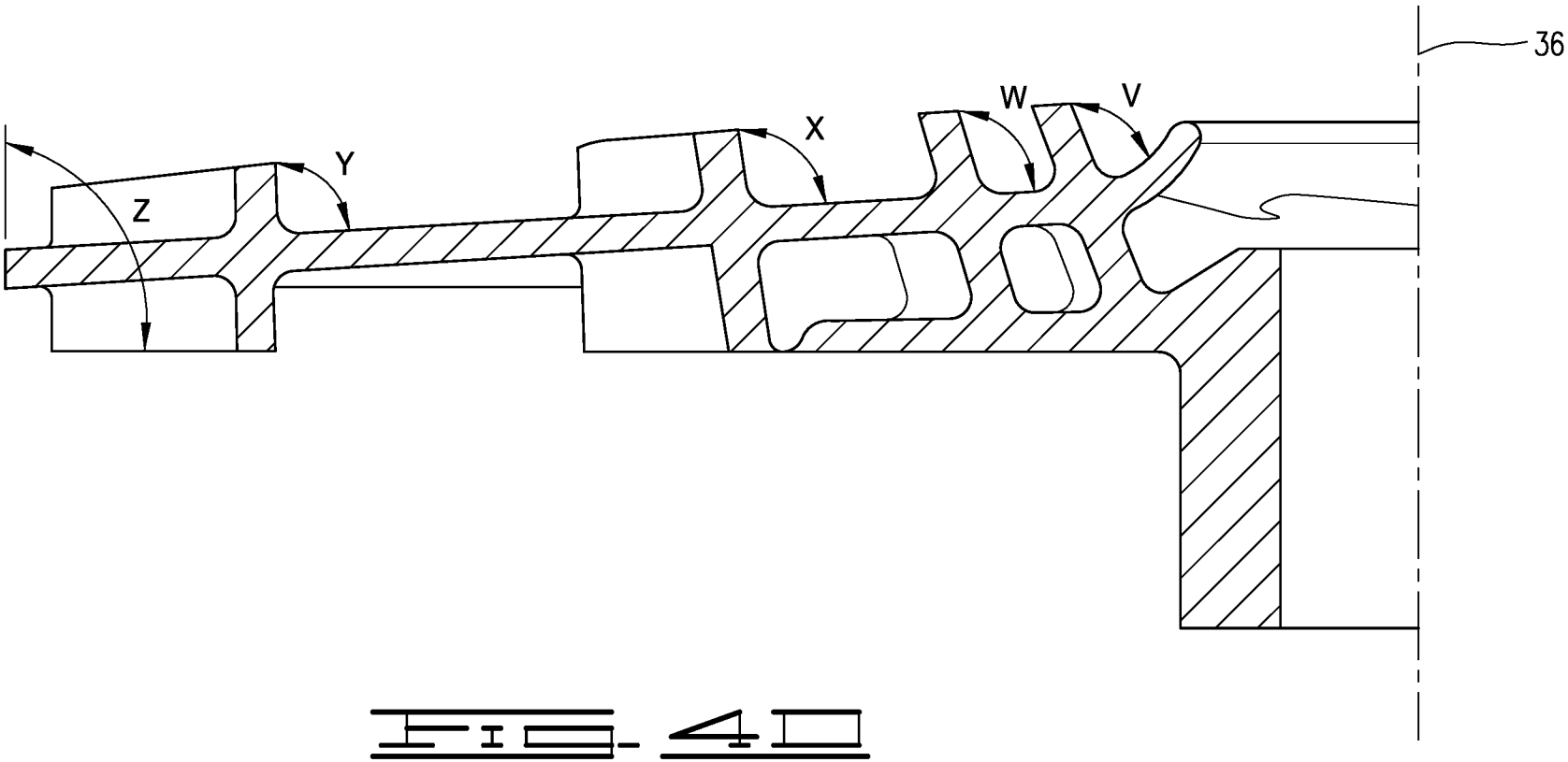
Figure 5:
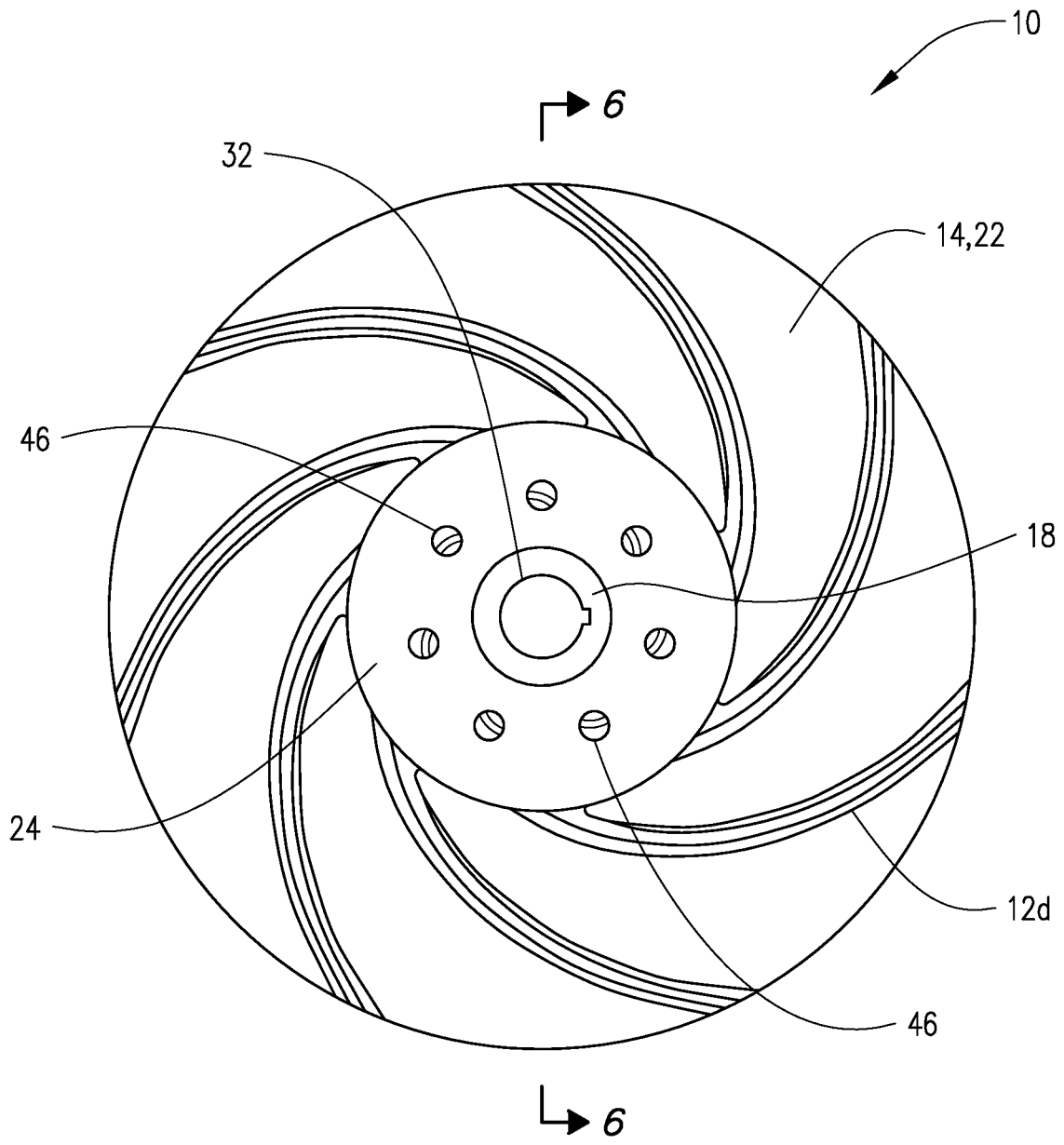
FIG. 5 is a top view of the backside of the impeller depicted in FIG. 3.
Figure 3:
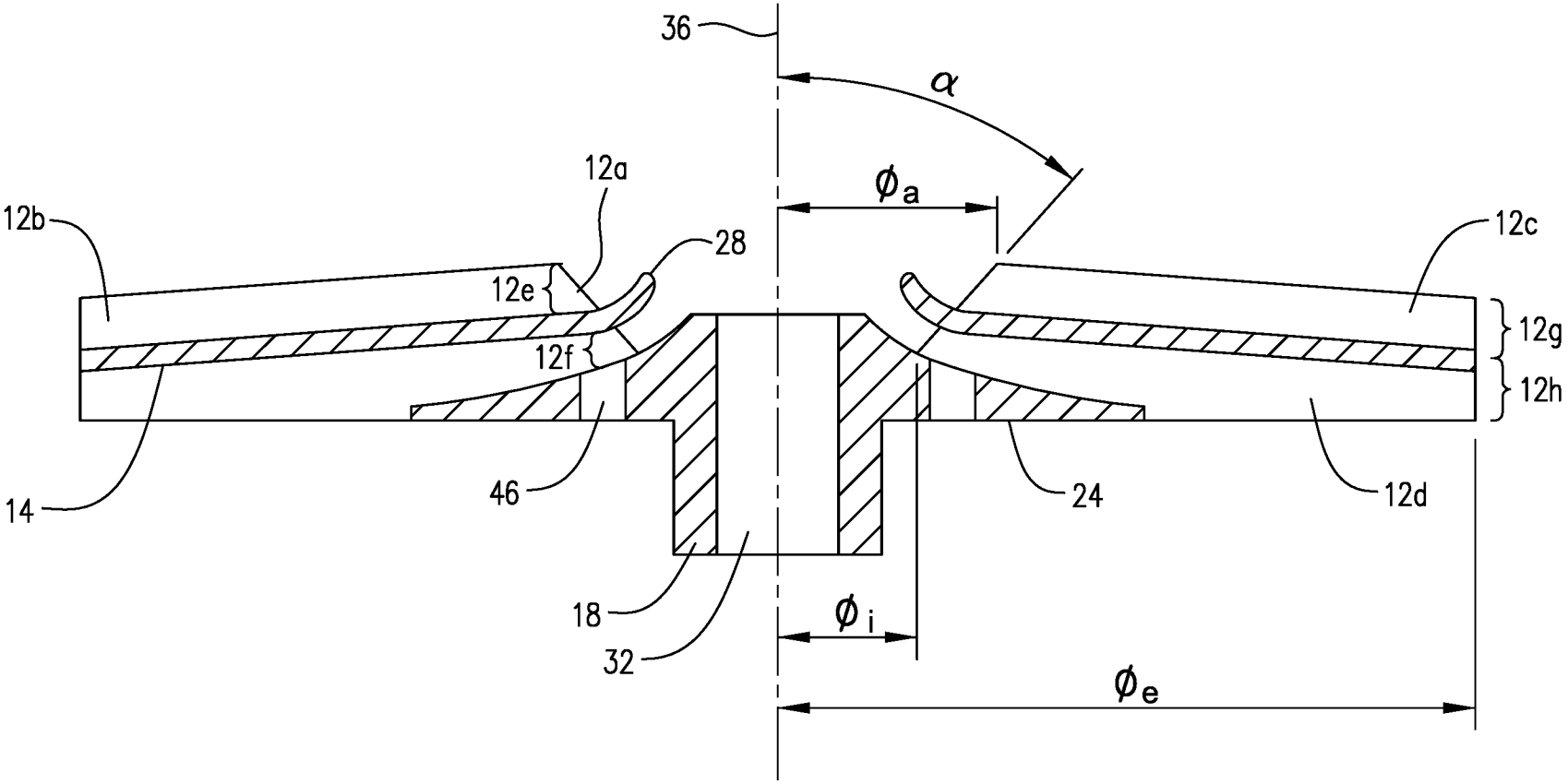

As used herein, 3D vane geometry refers to the angular relationships of vanes 12 to the other elements of impeller 10. As best seen in FIGS. 4A, 4C and 4D, vanes 12 transition from an obtuse angle relative intermediate plate 14 and axle hub plate 24 at location V (corresponds to 12*a*), with reference to the impeller center line defined by axle hole 32, to an acute angle relative to intermediate plate 14 at location Y or a substantially vertical angle relative to the plane defined by the backside of axle hub plate 24 at locations Y and Z (Z corresponds to 12*b*).

The 3D configuration of impeller 10 differs from the prior art impeller having 2D vane configurations. In 2D configuration, the vanes run across the intermediate plate with a constant angle of approximately 90°, relative to the plane defined by the back of the axle hub plate, from the interior hub to the exterior edge of the intermediate plate. An impeller with vanes of the 2D configuration has flow passages between the vanes that are too small in the region of the hub. Thus, the 2D configuration produces more cavitation than the 3D configuration discussed below. Additionally, the 2D configuration entrains an excess amount of air when compared to the 3D configuration described below.

With reference to FIGS. 4A, 4C and 4D, locations V through Z are referenced to reflect the change in the angular relationship of vanes 12 to intermediate plate 14 and the plane defined by the backside of axle hub plate 24. In general, at location V, vane 12 may define an angle of about 105° to about 110° relative to intermediate plate 14; more typically, at location V vane 12 will define an angle of about 110° relative to intermediate plate 14. At location W, vane 12 may define an angle of about 100° to about 105° relative to intermediate plate 14, more typically, at location W vane 12 will define an angle of about 104° relative to intermediate plate 14. At location X, vane 12 may define an angle of about 95° to about 100° relative to intermediate plate 14, more typically, at location X vane 12 will define an angle of about 96° relative to intermediate plate 14. At location Y, vane 12 may define an angle of about 85° to about 95° relative to intermediate plate 14, more typically, at location Y vane 12 will define an angle of about 87° relative to intermediate plate 14 and 90° relative to the plane defined by the backside of the axle hub plate 24. At location Z, vane 12 may define an angle of about 85° to about 95° relative to intermediate plate 14, more typically, at location Z vane 12 will define an angle of about 87° relative to intermediate plate 14 and 90° relative to the plane defined by the backside of the axle hub plate 24. Location X is approximately the midpoint along the length of vane 12. Location W is approximately the midpoint between points V and X while location Y is approximately the midpoint between points X and Z.

In addition to the unique angular relationship of vanes 12 relative to intermediate plate 14, first end 12*a* of each vane defines a specific angle relative to the impeller center line 36 defined by axle hole 32. As depicted in FIG. 6, end 12*a* of vane 12 defines an angle --α-- relative to the impeller center line. Angle --α-- may range from about 15° to about 30°. More preferably, angle --α-- will be between about 19° and about 24°. Angle --α-- is determined by distances Øa and Øi. Changes in Øa and Øi will of course change angle --α--. Distance Øi may range from about 36 mm to about 82 mm and distance Øa may range from about 44 mm to about 110 mm.

Additionally, the height of each vane section 12*c* and 12*d* varies as each section transitions from location 12*a* to 12*b*. At location 12*a*, the height 12*e* of first vane section 12*c* will typically be between about 11.5 mm and about 25.4 mm. With regard to second vane section 12*d*, at location 12*a* second vane section 12*d* will have a height 12*f* which is less than 12*e*. Height 12*f* will typically range from about 5.5 mm to about 15.7 mm. At end 12*b*, first vane section 12*c* will have a height 12*g*, where 12*g* may be about 4.3 mm to about 14.2 mm. Likewise at end 12*b*, second vane section 12*d* will have a height 12*h*, where 12*h* may be about 4.3 mm to about 14.2 mm. Further, in most embodiments, the height of first vane section 12*c* at location 12*a* will be greater than the height of impeller intermediate plate eye 28.

The 3D geometry of vanes 12 ensures that suction side 20 and backside 22 of impeller 10 move substantially equivalent volumes of liquid. Accordingly, when installed in pump 50 with diffuser 54 and case 52 in place, the volume defined by vanes first section 12*c* on suction side 20 of impeller 10 is at least approximately equal to the volume defined by vanes second section 12*d* on backside 22 of impeller 10. Preferably, volume defined by vanes first section 12*c* on suction side 20 of impeller 10 is equal to the volume defined by vanes second section 12*d* on backside 22 of impeller 10. The volume for each side of impeller 10 may also be determined by using the upper surface of first vane section 12*c* to define a plane as the boundary for volume calculation on the suction side and the lower surface of second vane section 12*d* to define a plane as the boundary for volume calculation of the backside along with the volume defined by fluid passages 34. Thus, the 3D geometry refers to the height of vane sections 12*c* and 12*d*, the angle of inclination of vanes 12 relative to intermediate plate 14 and the plane defined by the backside of axle hub plate 24 and the angle at the end of vanes 12 at location 12*a* relative to impeller center line 36.

The 3D geometry of vanes 12 in combination with impeller intermediate plate eye 28, fluid passages 34 and balancing holes 46 establishes fluid flow equilibrium on both sides of impeller 10. The improvements produced by the fluid flow equilibrium are evidenced in FIGS. 9-12.

Figure 10:
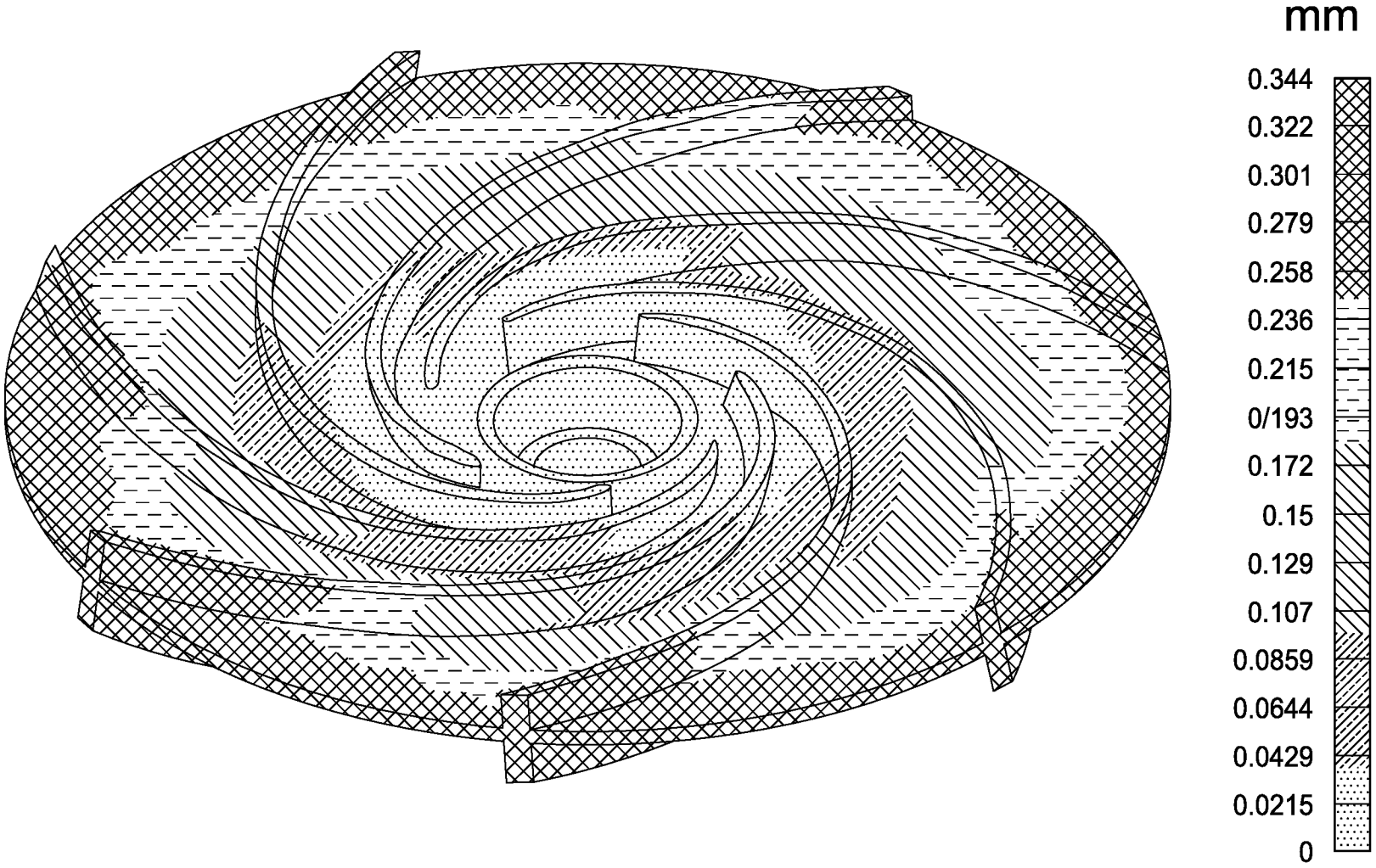
FIG. 10 is a computational stress analysis of the impeller depicted in FIG. 3 depicting the displacement of the impeller due to applied loads.

FIGS. 9 and 10 depict the improvements, i.e. stress reductions, provided by impeller 10. As depicted in FIG. 9, stresses on impeller 10 have been reduced to approximately 120 MPa as compared to stresses of more than 124.2 Mpa experienced by previous impellers design. In FIG. 9, the darker areas reflect lower stresses than the lighter areas. FIG. 10 demonstrates that the improved impeller also reduces axial thrust to a maximum displacement at the outer edge of 0.344 mm. In other words, the outer edge of intermediate plate is displaced by no more than 0.344 mm relative to axle hub 18. In contrast, prior impellers would typically experience maximum displacements of about 0.748 mm relative to the axle hub plate 24.

Figure 11:
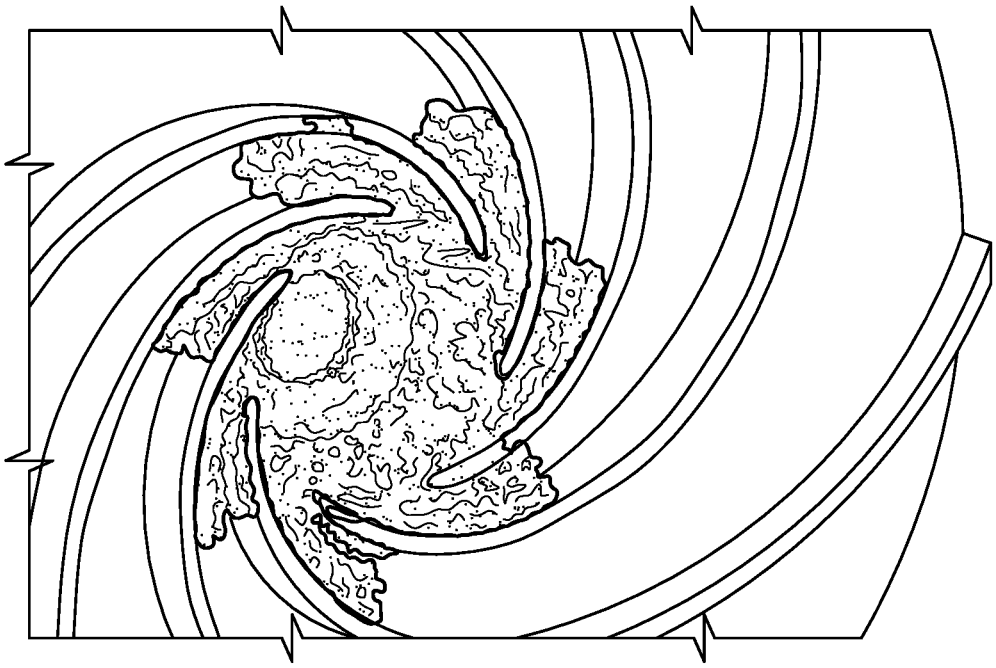
FIGS. 11 and 12 depict the difference in vapor generation, resulting from cavitation, between 2D vanes, i.e. vertical vanes, and 3D vanes, i.e. the angled vanes of the present invention.
Figure 12:
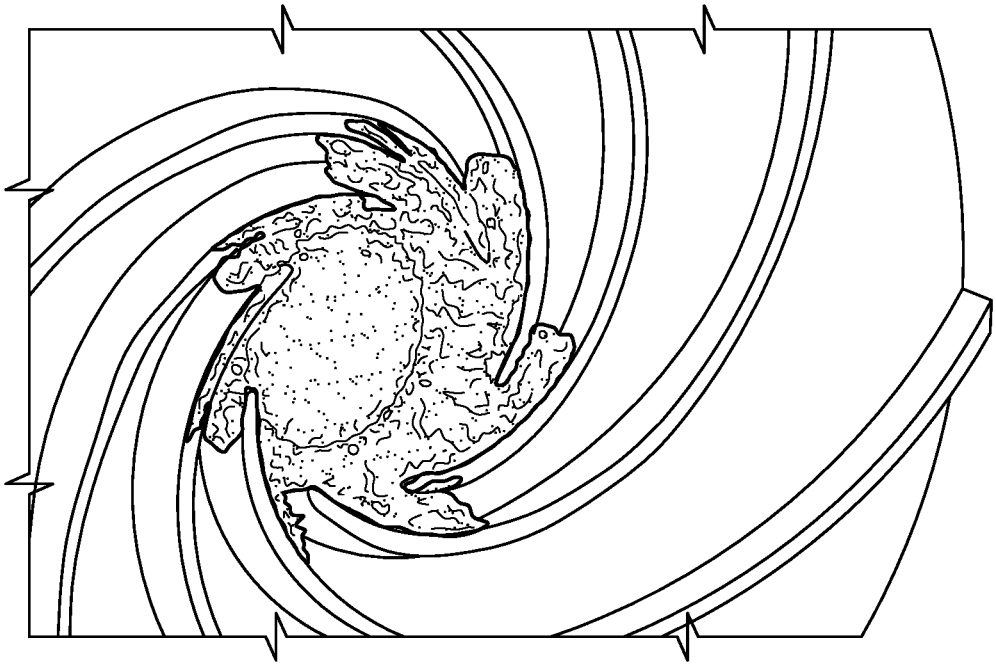

Additionally, the 3D geometry of impeller vanes 12 acts to reduce cavitation in the area of impeller intermediate plate eye 28. Thus, impeller 10 generates a smaller volume of air bubbles during operation. The reduced aeration of the pumped fluid in the area of impeller intermediate plate eye 28 is demonstrated by FIGS. 11 and 12. FIG. 11 reflects the generation of bubbles by conventional 2D or vertical vanes. FIG. 12 reflects the improvement provided by impeller 10 with 3D vane geometry.

Figure 13A:
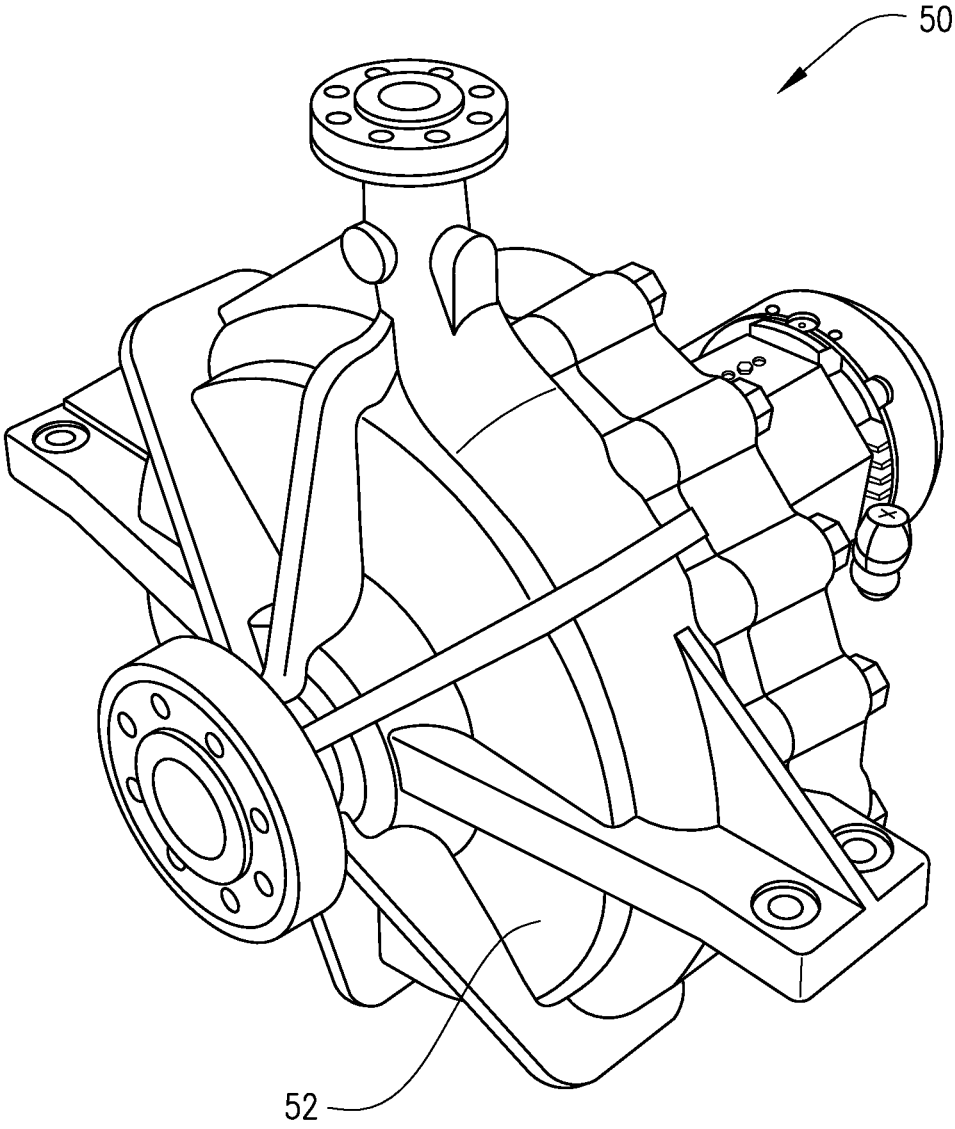
Figure 16:
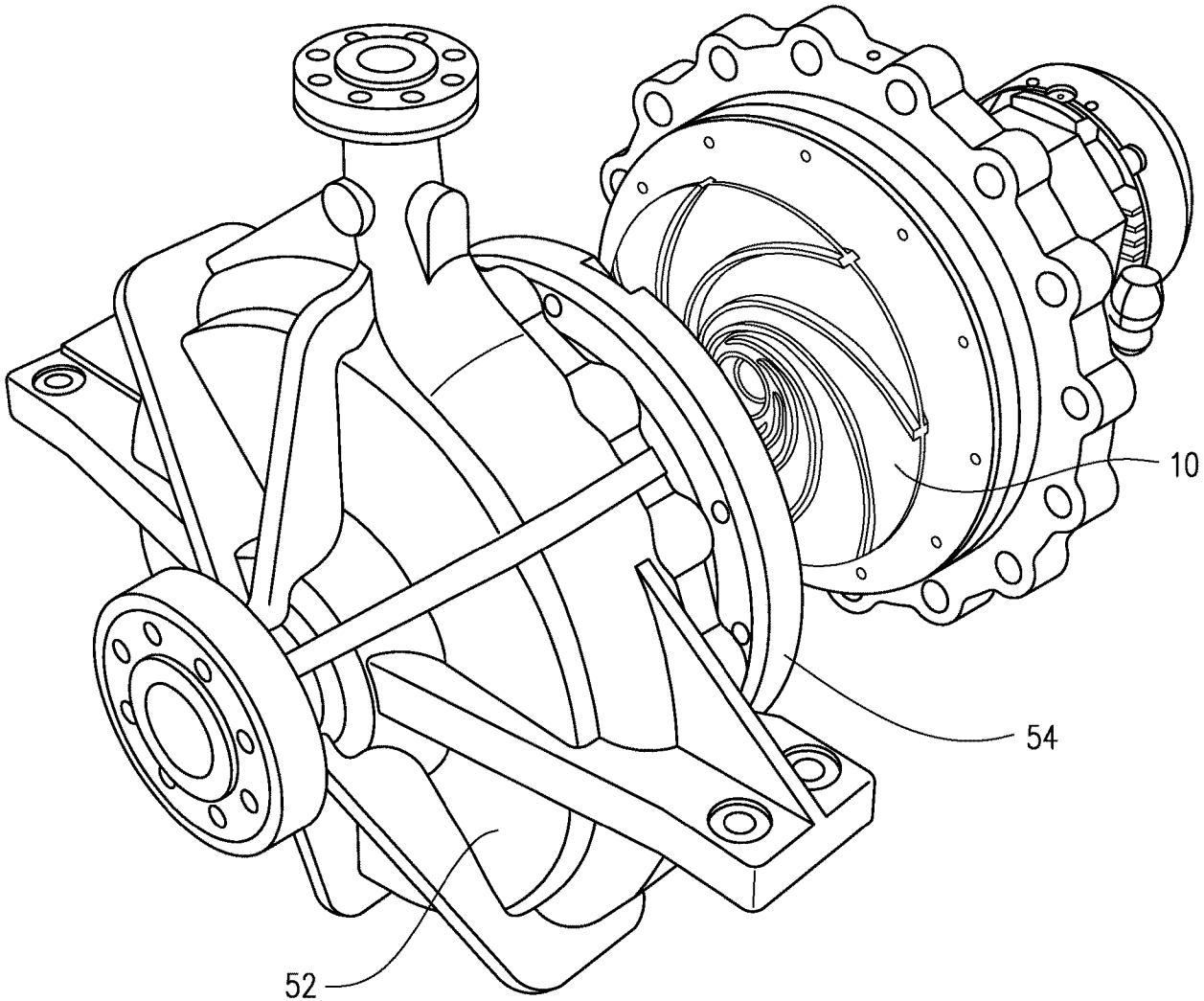

FIG. 13A depicts a pump 50 suitable for modification with impeller 10 disclosed herein. As reflected in the exploded view of FIG. 13B, impeller 10 will be incorporated in a conventional manner within the pump casing 52 with suction side 20 facing a conventional diffuser 54. No modifications to pump 50, pump casing 52 or diffuser 54 are required for incorporation of impeller 10.

Figure 7:
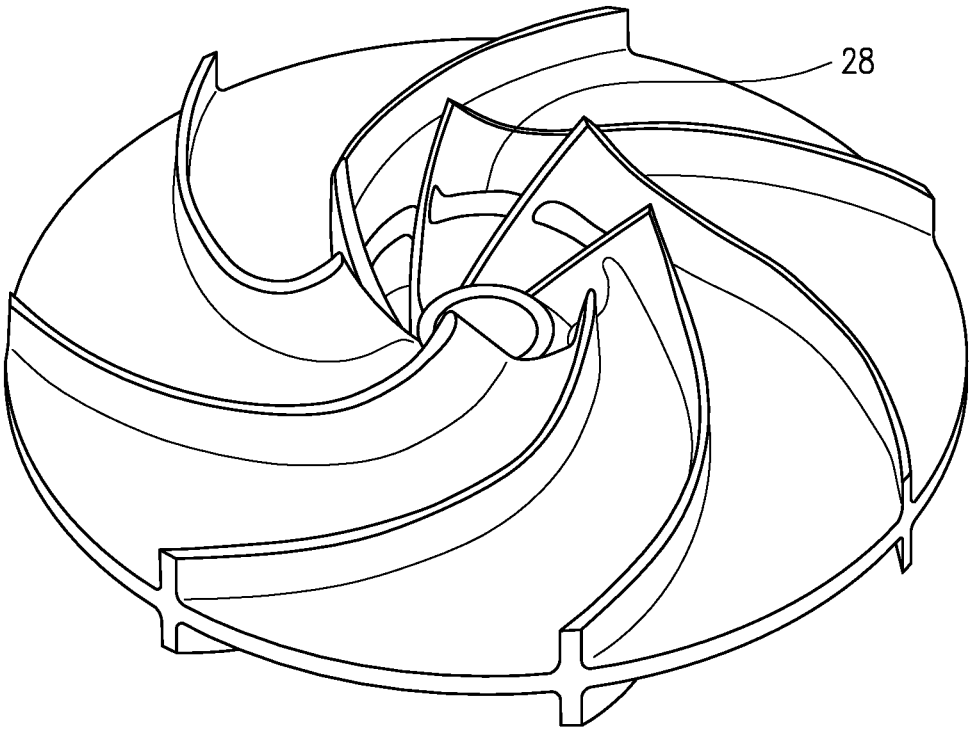
FIG. 7 is a perspective view of an alternative embodiment of the impeller where the vanes extend beyond the intermediate plate and the intermediate plate has a radius of curvature as it approaches the suction eye.
Figure 8:
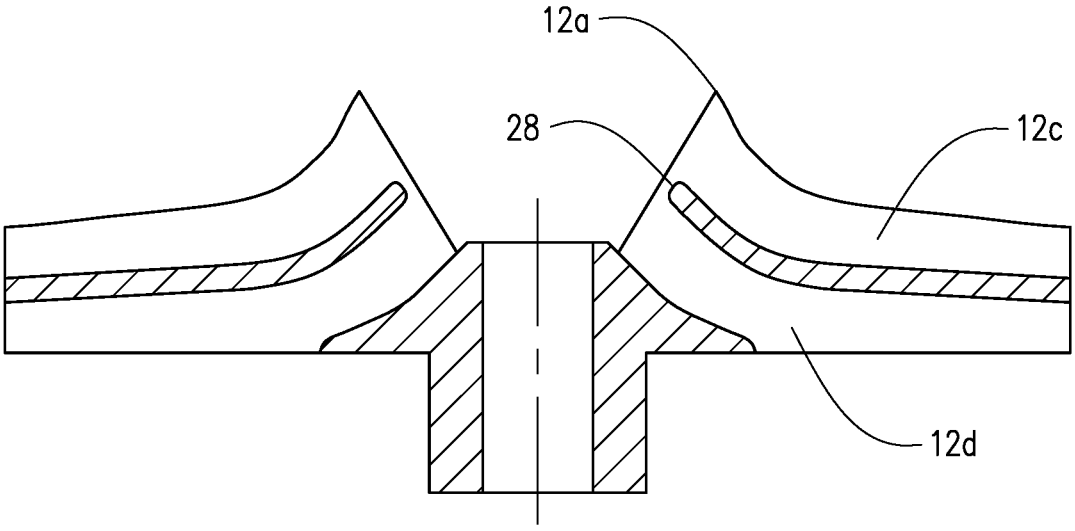
FIG. 8 is a side cross-sectional view of an alternative embodiment of the impeller in FIG. 8.
Figure 5:
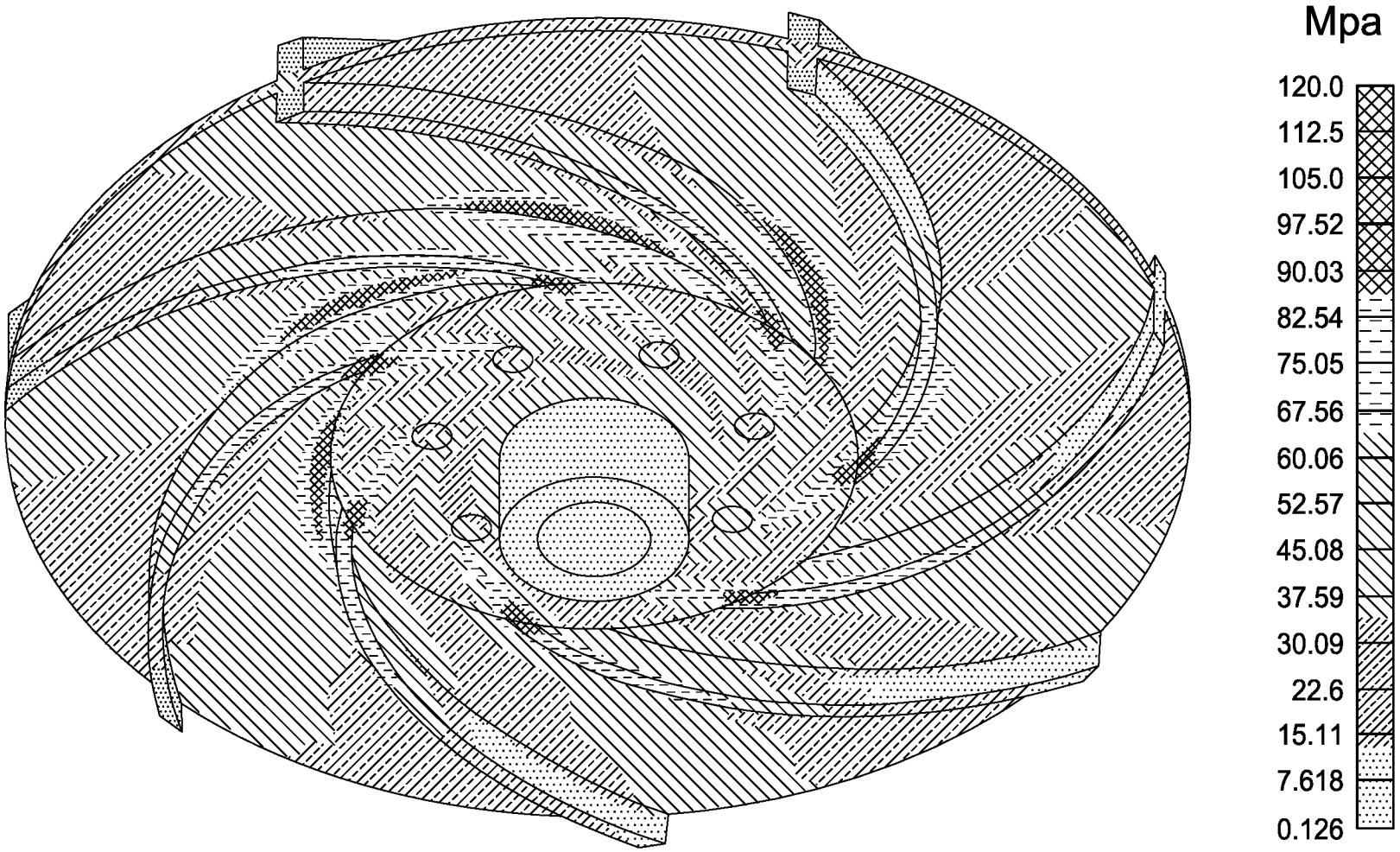

FIGS. 7 and 8 depict an alternative embodiment of impeller 10. In this embodiment, intermediate plate 14 forms impeller intermediate plate eye 28 by deflecting upwards at a location earlier than that depicted in the other FIGS. In this embodiment, the radius of curvature at impeller intermediate plate eye 28 may be about 53 mm to about 70 mm. Additionally, the embodiment depicted in FIGS. 7 and 8 reflect a configuration wherein vanes 12 extend beyond intermediate plate at location 12*a*. Thus, at location 12*a* in the embodiment of FIGS. 7 and 8, vane first and second sections are not bisected by intermediate plate 14.

Other embodiments of the present invention will be apparent to one skilled in the art. As such, the foregoing description merely enables and describes the general uses and methods of the present invention. Accordingly, the following claims define the true scope of the present invention.

What is claimed is:

1. An impeller for a centrifugal pump comprising:

an intermediate plate defining a suction side and a backside;

a hub plate, said hub plate having an axle hole passing there through, the center of said axle hole defines a center line of said impeller;

an impeller intermediate plate eye on the suction side of said intermediate plate, said impeller intermediate plate eye concentric with said axle hole;

a plurality of vanes bisected by said intermediate plate wherein each vane has a first vane section located on said suction side of said intermediate plate and a second vane section located on said back side of said intermediate plate, wherein at least a portion of said second vane sections join said hub plate to said intermediate plate and define fluid passageways between said intermediate plate and said hub plate;

each of said vanes has a first end proximate to said impeller intermediate plate eye and a second end located at the outer edge of said intermediate plate;

a plurality of balancing holes passing through said hub plate, said balancing holes positioned concentrically about said axle hub and at least one balancing hole is positioned between adjacent second vane sections;

wherein each vane first end defines an angle of about 15° to about 25° relative to said center line of said impeller and wherein each vane second end defines an angle of about 90° relative to the center line of said impeller;

wherein each vane first end has an angle of inclination relative to said hub plate that is greater than an angle of inclination relative to said hub plate at said vane second end.

2. The impeller of claim 1, wherein said first vane section has a first height at said vane first end that is greater than the height of said second vane section at said first end.

3. The impeller of claim 2, wherein said first vane section has a second height at said vane second end that is substantially equal to the height of said second vane section at said second end.

4. The impeller of claim 1, wherein said angle defined by each vane first end is from about 19° to about 24° relative to said center line of said impeller.

5. The impeller of claim 1, wherein said intermediate plate defines an angle of about 3° to about 5° relative to a plane defined by the back side of said hub plate.

6. The impeller of claim 5, wherein said first vane section has an angle of inclination at the first end of each vane of about 105° to about 110° relative to the plane corresponding to the back side of said hub plate.

7. The impeller of claim 5, wherein said first vane section has an angle of inclination at the first end of each vane of about 105° to about 110° relative to the intermediate plate, an angle of about 95° to about 100° relative to the intermediate plate at a mid-point between said first end and said second end of said vane and an angle of about 85° to 95° relative to the intermediate plate at said second end of said vane.

8. The impeller of claim 7, wherein said first vane section has a first height at said vane first end that is greater than the height of said second vane section at said first end, wherein said first vane section has a second height at said vane second end that is substantially equal to the height of said second vane section at said second end; and, wherein the volume defined by the suction side of said intermediate plate and the first vane sections is approximately equal to the volume defined by the backside of said intermediate plate and said second vane sections and said fluid passageways between said intermediate plate and said hub plate.

9. The impeller of claim 8, wherein said impeller intermediate plate eye, said balancing holes, and said fluid passageways between said intermediate plate and said hub plate provide fluid communication between said suction side of said impeller and said backside of said impeller.

10. The impeller of claim 9, wherein said impeller intermediate plate eye is an extension of said intermediate plate and said impeller intermediate plate eye has an upward radius of curvature of about 20 mm to about 45 mm.

11. The impeller of claim 10, wherein said intermediate plate extends beyond said vanes.

12. The impeller of claim 10, wherein said vanes extend beyond said intermediate plate.

13. An impeller for a centrifugal pump comprising:

an intermediate plate defining a suction side and a backside;

a hub plate, said hub plate having an axle hole passing therethrough, the center of said axle hole defines a center line of said impeller;

an impeller intermediate plate eye carried on the suction side of said intermediate plate, said impeller intermediate plate eye concentric with said axle hole;

a plurality of vanes bisected by said intermediate plate wherein each vane has a first vane section located on said suction side of said intermediate plate and a second vane section located on said back side of said intermediate plate, wherein at least a portion of said second vane sections join said hub plate to said intermediate plate and define fluid passageways between said intermediate plate and said hub plate;

each of said vanes has a first end proximate to said impeller intermediate plate eye and a second end located at the outer edge of said intermediate plate;

a plurality of balancing holes passing through said hub plate, said balancing holes positioned concentrically about said axle hub and at least one balance hole is positioned between adjacent second vane sections;

wherein each vane first end defines an angle of about 15° to about 25° relative to said center line of said impeller and wherein each vane second end defines an angle of about 90° relative to the center line of said impeller;

wherein each vane defines a 3D configuration wherein said vane first end has an angle of inclination relative to said hub plate that is greater than the angle of inclination at said vane second end;

wherein said first vane section has a first height at said vane first end that is greater than the height of said second vane section at said first end, wherein said first vane section has a second height at said vane second end that is substantially equal to the height of said second vane section at said second end; and, wherein the volume defined by the suction side of said intermediate plate and the first vane sections is approximately equal to the volume defined by the backside of said intermediate plate and said second vane sections and said fluid passageways between said intermediate plate and said hub plate.

14. The impeller of claim 13, wherein said first vane section has a first height at said vane first end that is greater than the height of said second vane section at said first end.

15. The impeller of claim 14, wherein said first vane section has a second height at said vane second end that is substantially equal to the height of said second vane section at said second end.

16. The impeller of claim 13, wherein said angle defined by each vane first end is from about 19° to about 24° relative to said center line of said impeller.

17. The impeller of claim 13, wherein said intermediate plate defines an angle of about 3° to about 5° relative to a plane defined by the back side of said hub plate.

18. The impeller of claim 17, wherein said first vane section has an angle of inclination at the first end of each vane of about 105° to about 110° relative to the plane corresponding to the back side of said hub plate.

19. The impeller of claim 17, wherein said first vane section has an angle of inclination at the first end of each vane of about 105° to about 110° relative to the intermediate plate, an angle of about 95° to about 100° relative to the intermediate plate at a mid-point between said first end and said second end of said vane and an angle of about 85° to 95° relative to the intermediate plate at said second end of said vane.

20. The impeller of claim 13, wherein said impeller intermediate plate eye, said balancing holes, and said fluid passageways between said intermediate plate and said hub plate provide fluid communication between said suction side of said impeller and said backside of said impeller.

21. The impeller of claim 20, wherein said impeller intermediate plate eye is an extension of said intermediate plate and said impeller intermediate plate eye has a radius of curvature of about 20 mm to about 45 mm.

22. The impeller of claim 21, wherein said intermediate plate extends beyond said vanes.

23. The impeller of claim 21, wherein said vanes extend beyond said intermediate plate.

* * * * *